US005398827A

United States Patent [19]

Armstrong et al.

[11] Patent Number: 5,398,827

[45] Date of Patent: Mar. 21, 1995

[54] MULTI-VESSELLED BEVERAGE CONTAINER

[75] Inventors: Robert Armstrong; Susan E. Johnson; Maryann Bott, all of Chicago, Ill.

[73] Assignee: Flair Communications Agency, Inc., Chicago, Ill.

[21] Appl. No.: 110,154

[22] Filed: Aug. 20, 1993

[51] Int. Cl.[6] ..... B65D 1/04

[52] U.S. Cl. ..... 215/6; 128/762; 422/102

[58] Field of Search ..... 215/6; 206/443; 128/762, 763; 422/102

[56] References Cited

U.S. PATENT DOCUMENTS

| | | | |
|---|---|---|---|
| 3,987,892 | 10/1976 | Killy | 206/443 X |
| 4,150,089 | 4/1979 | Linet | 215/6 X |
| 4,456,580 | 6/1984 | Yamada et al. | 422/102 X |
| 4,613,042 | 9/1986 | Aeschliman | 206/443 X |
| 4,675,299 | 6/1987 | Witty et al. | 422/102 X |
| 4,979,402 | 12/1990 | Ryan et al. | 128/762 X |
| 5,009,942 | 4/1991 | Benin et al. | 422/102 X |
| 5,223,245 | 6/1993 | Ibrahim et al. | 215/6 X |

OTHER PUBLICATIONS

Four photographs of "Kahlua mooo juice" container.

*Primary Examiner*—Allan N. Shoap
*Assistant Examiner*—Christopher McDonald
*Attorney, Agent, or Firm*—Rudnick & Wolfe

[57] ABSTRACT

A multi-vesselled beverage container including at least two elongated vessels or tubes which are connected in an adjacent relationship relative to each other. Each tube has an open top portion and a closed bottom portion such that each tube can hold a beverage therein. The tubes are connected such that the top portions of the tubes are disposed in generally coplanar relation relative to each other. The cross-sectional configuration of the tubes are specifically sized toward the top portions thereof to define a cumulative width between opposite sides of the tubes to facilitate simultaneous and direct pouring of the beverages from the tubes into a person's mouth whereat the beverages commingle with each other to provide a taste sensation different than that provided by either individual beverage.

9 Claims, 5 Drawing Sheets

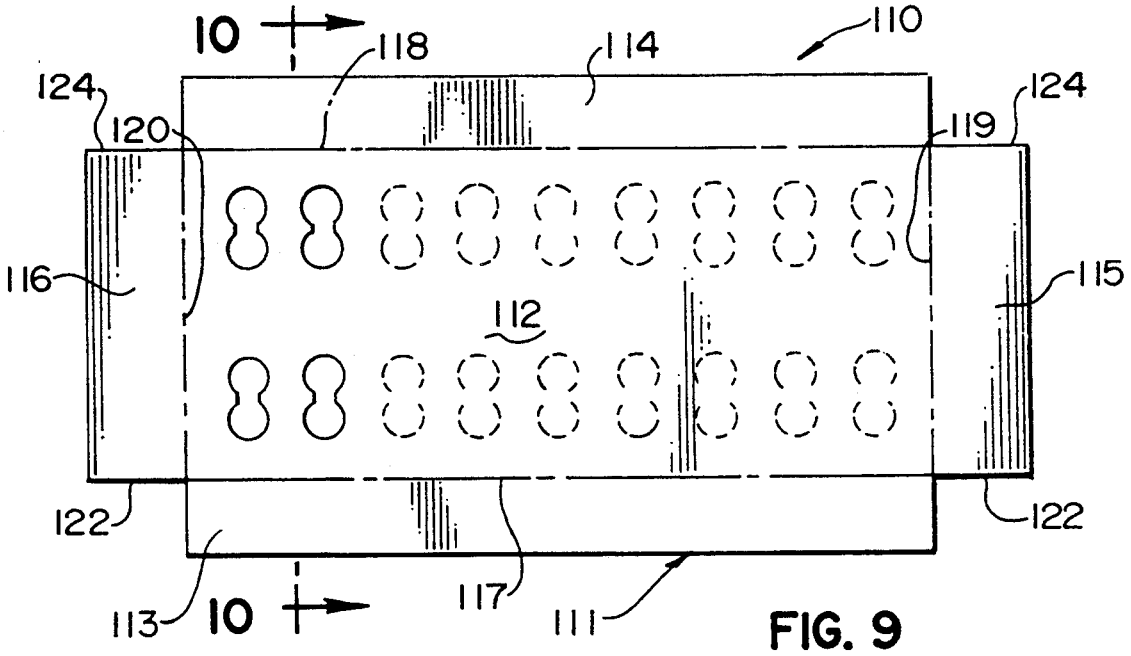
FIG. 9
FIG. 10
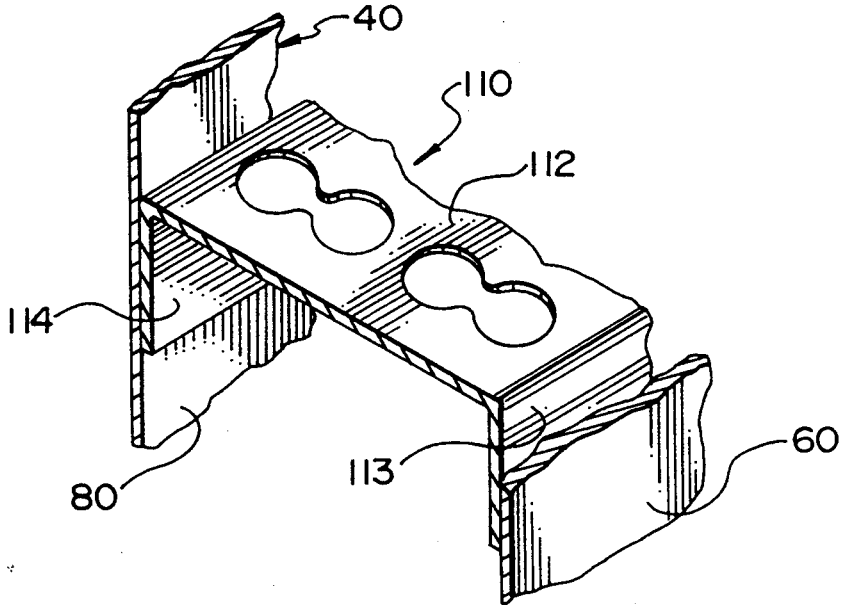

MULTI-VESSELLED BEVERAGE CONTAINER

FIELD OF THE INVENTION

The present invention generally relates to beverage containers and, more particularly, to a beverage container having at least two elongated and adjacent vessels for accommodating different beverages which are to be simultaneously poured into a person's mouth to provide a taste sensation different from that provided by either beverage taken alone.

BACKGROUND OF THE INVENTION

Mixing two different beverages to provide a taste sensation different from either of the beverages taken independently, is well known and is a common practice. For example, mixing a hot chocolate drink with peppermint schnapps will provide a decidedly different taste than either of the two beverages can provide independently from one another.

Although commingling or combining two beverages is well known, a problem exists as to how to effect such ends in an economic and efficient manner. Of course, providing each beverage in a glass or mug is one answer. Drinking one beverage followed by drinking a second beverage often fails to provide the same taste sensation as when those two beverages are commingled and drunk together. Besides being cumbersome, pouring a beverage from one glass into another glass can easily result in spillage and, therefore, such approach has a certain sense of wastefulness associated therewith. In many instances, and especially when alcohol is involved, a person may desire to consume only one drink which involves a combined liquid total of about two ounces. Thus, the normal capacity of either glasses or mugs does not readily lend themselves to drinks or beverages formulated from only approximately two ounces. Moreover, in a drinking establishment, such as a bar and the like, a bartender or server very often does not have time to prepare such a small volume of a particular beverage or drink, i.e. a hot chocolate drink. Providing appropriate quantities of each beverage to achieve the desired taste, therefore, it also a problem when using glasses or mugs to formulate the type of mixed drinks or beverages with which the present invention finds utility.

Mixed drinks or beverages are common place in drinking establishments such as restaurants and bars. Because of the relatively small liquid volume associated with each individual drink, however, uncommon mixes of different beverages makes economical sense only when relatively large numbers of such drinks can be simultaneously prepared and provided. It has long been recognized that sales of beverages are enhanced by advertisements and signage associated with a particular drink. The ability to display the drink in close proximity with the signage or advertisement furthermore promotes sales. A problem with signs, however, involves their portability and the space they consume for shipping and storage.

Thus, there is a need and a desire for a one-piece beverage container which is capable of holding at least two different beverages of relatively small volumes and which allows both beverages to be simultaneously poured from the container directly into the mouth of a person whereat the different beverages commingle to provide a unique taste sensation. Moreover, there is a need and a desire for a display which is capable of holding such a container and which is collapsible to facilitate shipping and storage of the container.

SUMMARY OF THE INVENTION

In view of the above, and in accordance with the present invention, one aspect of the present invention relates to a multi-vesselled beverage container which includes at least two elongated vessels, or tubes which are connected in adjacent relationship relative to each other. Each tube has an open top portion and a closed bottom portion such that each tube can hold a liquid beverage therein. The tubes are connected such that the top portion of the tubes are disposed in generally coplanar relation relative to each other. The cross-sectional configuration of the tubes are specifically sized toward the top portions thereof to define a cumulative width between opposite sides of the tubes to facilitate pouring of the beverage contents of the tubes simultaneously and directly into a person's mouth whereat the beverages commingle with each other to provide a desired taste sensation.

According to the present invention, each of the tubes are fabricated from a material chosen from the class of glass or plastic. In either embodiment, each tube provides visual access with limited distortion to the beverage contained therewithin. In a most preferred form of the invention, the tubes of the beverage container are fabricated from a clear plastic molded material. The tubes forming the beverage container are preferably fabricated from a material which insulates the beverages held in the tubes from each other whereby temperature gradients between the beverages held within the tubes is minimized.

In a most preferred from of the invention, each tube has a volumetric capacity in the range of about 0.5 ounces to about 2.5 ounces. Preferably, the tubes have substantially similar volumetric capacities for holding a beverage. In a most preferred form of the invention, the tubes are furthermore similar in size and shape relative to each other.

The multi-vesselled beverage container of the present invention can further include a cover which seals the top portions of the tubes and which is removable therefrom to permit access to the beverage contained within each tube, In one form of the invention, a releasable cap combines with and fits over the top portions of the tubes to prevent inadvertent release of the beverages from the tubes.

Another aspect of the present invention relates to a display for holding a plurality of dual vesselled beverage containers as described above. The display holds and supports a plurality of dual vesselled beverage containers in a vertically upright and supported orientation. The display preferably has a rectangular configuration defining top and bottom panels which are joined by side panels and further includes a midpanel which is connected to the side panels and extends generally parallel to the top and bottom panels. Closure flaps on opposite sides of the box-like display add rigidity and strength to the display. A unique feature of the display relates to the ability to collapse the panels upon themselves to minimize space requirements and thereby facilitate shipping and storage of the display.

The top panel and midpanel of the display define a plurality of openings. Each opening includes vertically aligned and specifically configured apertures for slidably accommodating a dual vesselled beverage container. Each aperture includes first and second generally circular holes which are joined to each other by a central passage, and wherein the diameter of the first and second holes define support surfaces for the tubes being slidably arranged within the display.

Providing a multi-vesselled beverage container solves the problem of how to simultaneously deliver and commingle two different mixtures to provide a unique and distinct taste sensation. As will be appreciated, arranging the top portion of the beverage container in a coplanar relationship while specifically sizing the top portion of the beverage container promotes simultaneous delivery of at least two beverages directly into a person's mouth whereat the beverages commingle to create a different taste sensation without the use of separate glasses or mugs. Moreover, the provision of a display allows several multi-vesselled beverage containers to be provided at a common location with adequate signage provided on the display for promoting the drink. Albeit relatively rigid and steady in its erected state, an advantage of the display relates to its ability to readily collapse into a flat readily transportable and storable item.

Numerous other features and advantages of the present invention will become readily apparent from the following detailed description, appended claims and the attached drawings.

BRIEF DESCRIPTION OF THE DRAWINGS

FIG. 9 is a top plan view of a midpanel used to form part of the display;

FIG. 10 is a perspective view in section showing the midpanel folded and secured relative to the remainder of the display;

DETAILED DESCRIPTION OF THE PRESENT INVENTION

Figure 3:
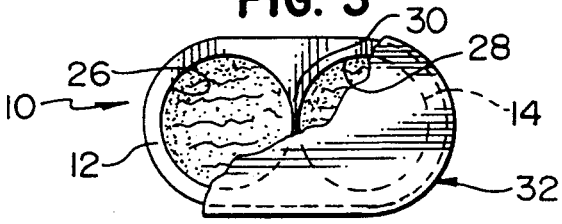
FIG. 3 is a top plan view of the beverage container shown in FIG. 2 with a portion of a cover shown attached thereto.
Figure 1:
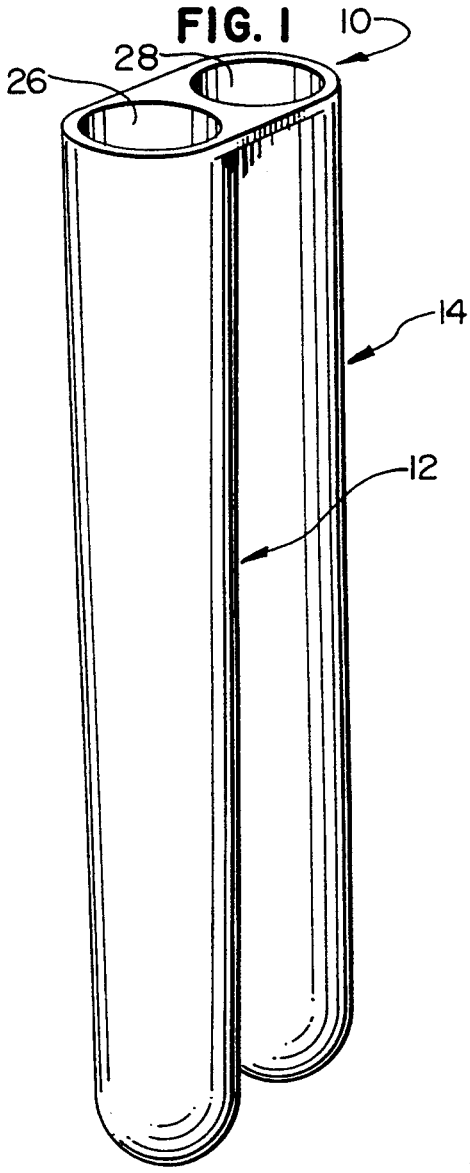
FIG. 1 is a perspective view of a multi-vesselled beverage container according to the present invention.

While the present invention is susceptible of embodiment in various forms, there is shown in the drawings a presently preferred embodiment hereinafter described, with the understanding that the present disclosure is to be considered as an exemplification of the invention and is not intended to limit the invention to the specific embodiment illustrated.

Referring now to the drawings, wherein like reference numerals refer to like parts throughout the several views, there is shown a multi-vesselled beverage container 10. As shown, container 10 includes at least two elongated vessels or tubes 12 and 14 which are connected in an adjacent and generally parallel relationship relative to each other. In the illustrated embodiment, tubes 12 and 14 are generally cylindrically-shaped and are integrally joined to each other along at least a portion of their length.

Figure 2:
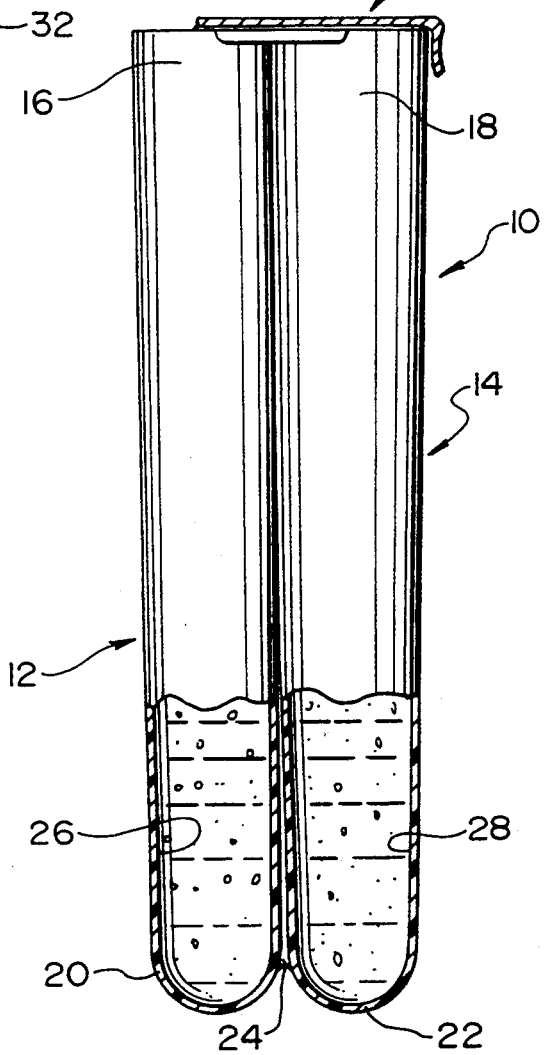
FIG. 2 is an elevational view of a multi-vesselled beverage container, with parts broken away for purposes of clarity.
Figure 4:
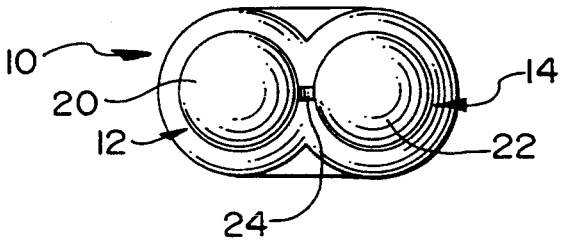
FIG. 4 is a bottom plan view of the beverage container of the present invention.

Turning to FIG. 2, tubes 12 and 14 are connected to each other such that open top portions 16 and 18 of the tubes 12 and 14, respectively, are arranged in a generally coplanar relation relative to each other. As shown, tubes 12 and 14 have a substantially similar size and shape relative to each other. As shown, each tube tapers along its length from the open top portions 16 and 18 to closed bottom portions 20 and 22, respectively. In the illustrated embodiment, a web 24 (FIG. 4) extends between the bottom end portions of the tubes to add strength and rigidity to the container.

As seen in FIGS. 2 and 3, tube 12 defines a blind cavity 26 for receiving and holding a suitable beverage therein. Tube 14 likewise defines a blind cavity 28 for holding and receiving another suitable beverage therewithin. In the illustrated embodiment, the cavities 26, 28 each have a similar volumetric capacity in the range of about 0.5 ounces to about 2.5 ounces. As will be appreciated, however, the outer configurations of the tubes 12 and 14 can vary relative to each other, and the volumetric capacity of the cavities 26 and 28 can vary relative to each other, without detracting or departing from the spirit and scope of the present invention.

The container 10 of the present invention is preferably fabricated from a material chosen from a class of either glass or plastic. In a most preferred form of the invention, the container 10 is fabricated as by a plastic molding process which is well-known in the molding art. Whether fabricated from glass or plastic, the tubes 12 and 14 of container 10 are preferably transparent or clear along the entirety of their length to provide visual access with limited distortion to the beverage contained therewithin.

As seen in FIG. 3, at least one wall or web 30 extends between and for the length of each cavity 26 and 28 to prevent commingling of the beverages contained in each cavity as long as the container 10 is maintained in a generally upright orientation. As will be appreciated, fabricating the container 10 from either plastic or glass along with a wall 30 which separates the cavities 26 and 28, insulates the beverages held in the tubes 12 and 14 from each other whereby temperature gradients between the beverages within the cavities 26 and 28 is minimized.

The bottom end portions 20 and 22 of the tube 12 and 14, respectively, preferably have a tapered configuration. In the illustrated embodiment shown in FIGS. 2 and 4, the bottom or terminal end of each tube has a spherical configuration.

In a preferred embodiment, the multi-vesselled beverage container 10 is sealed to prevent inadvertent release of the beverages from the cavities 26 and 28. As shown in FIG. 2, beverage container 10 is preferably equipped with a releasable seal or cover 32 which fits over the top portions 16 and 18 of the tubes 12 and 14, respectively. In the illustrated embodiment, the cover 32 is sized to fit over both the tubes 12 and 14. It is well within the scope of the present invention, however, for separate covers to be provided for each tube 12 and 14. In the illustrated embodiment, cover 32 is formed from a suitably pliable plastic which allows the cover 32 to maintain a releasable sealing relationship with the container 10 and which is readily removable from the container to permit access to the cavities 26 and 28 and/or the beverages contained therewithin.

Figure 5:
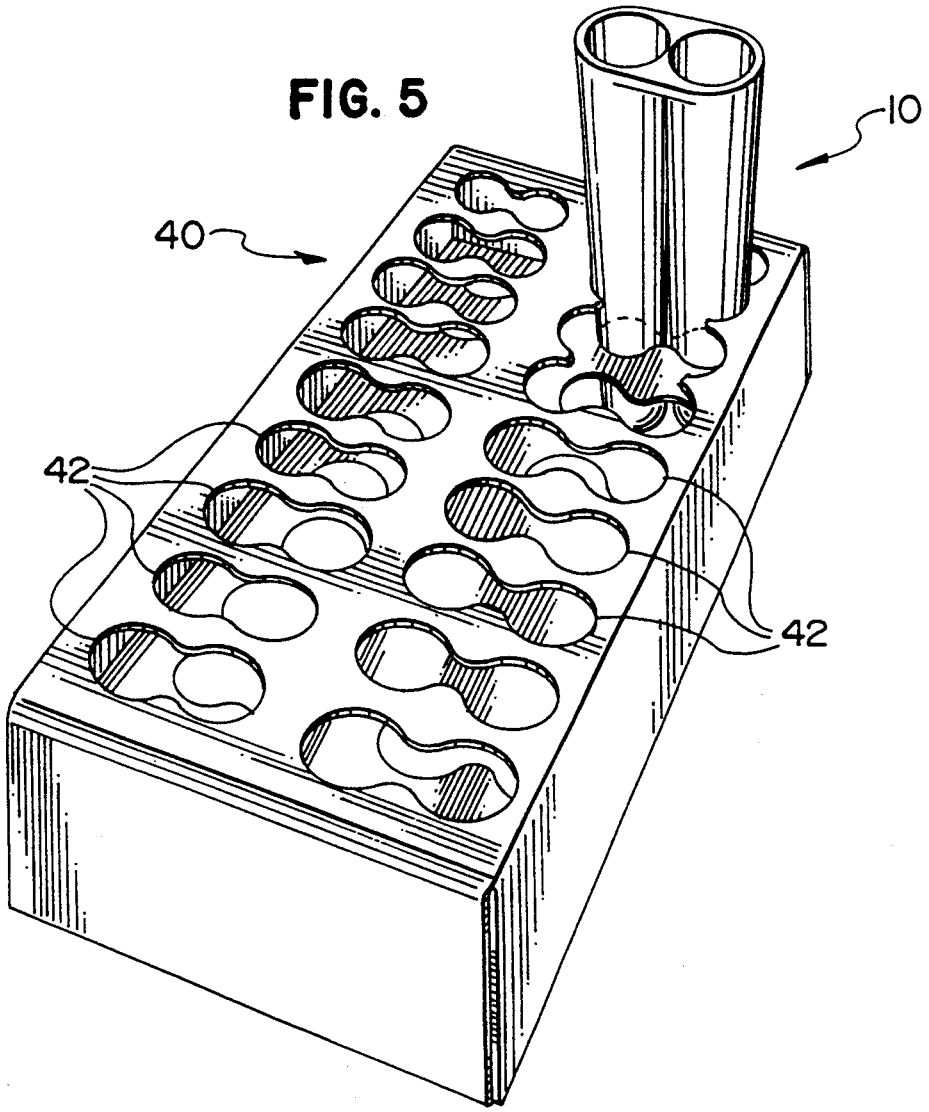
FIG. 5 is a perspective view of a display which slidably accommodates and vertically supports a plurality of multi-vesselled beverage containers.
Figure 6:
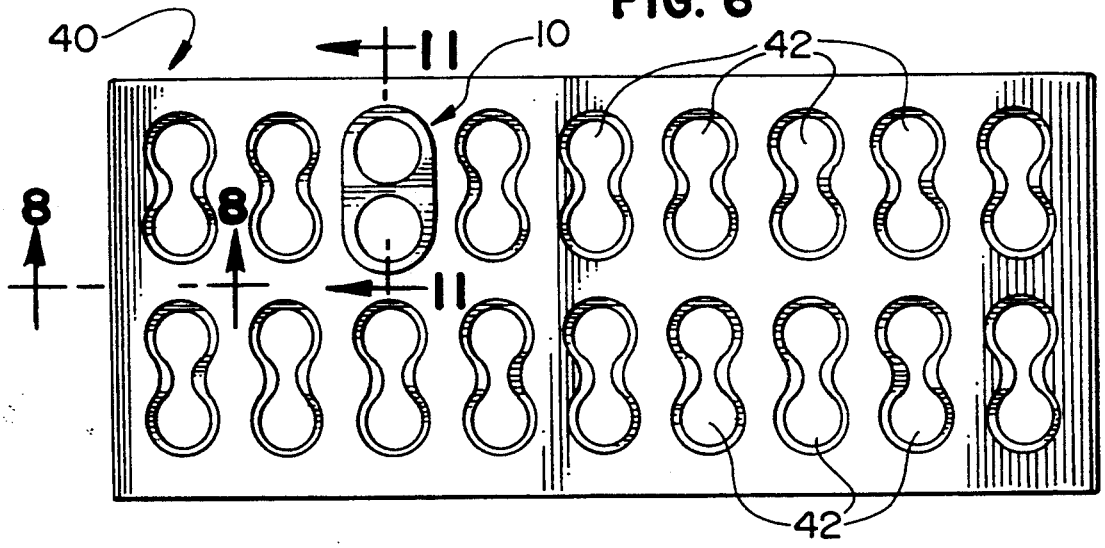
FIG. 6 is a top plan view of the display.

Another feature of the present invention relates to a stand alone type display 40 for supporting a plurality of dual vesselled beverage containers as described above in a generally vertical orientation. As shown in FIGS. 5 and 6, the display 40, in the preferred embodiment of the invention, has a box-like configuration and includes a series of openings 42 for slidably accommodating and vertically supporting a plurality of dual vesselled beverage containers.

Figure 7:
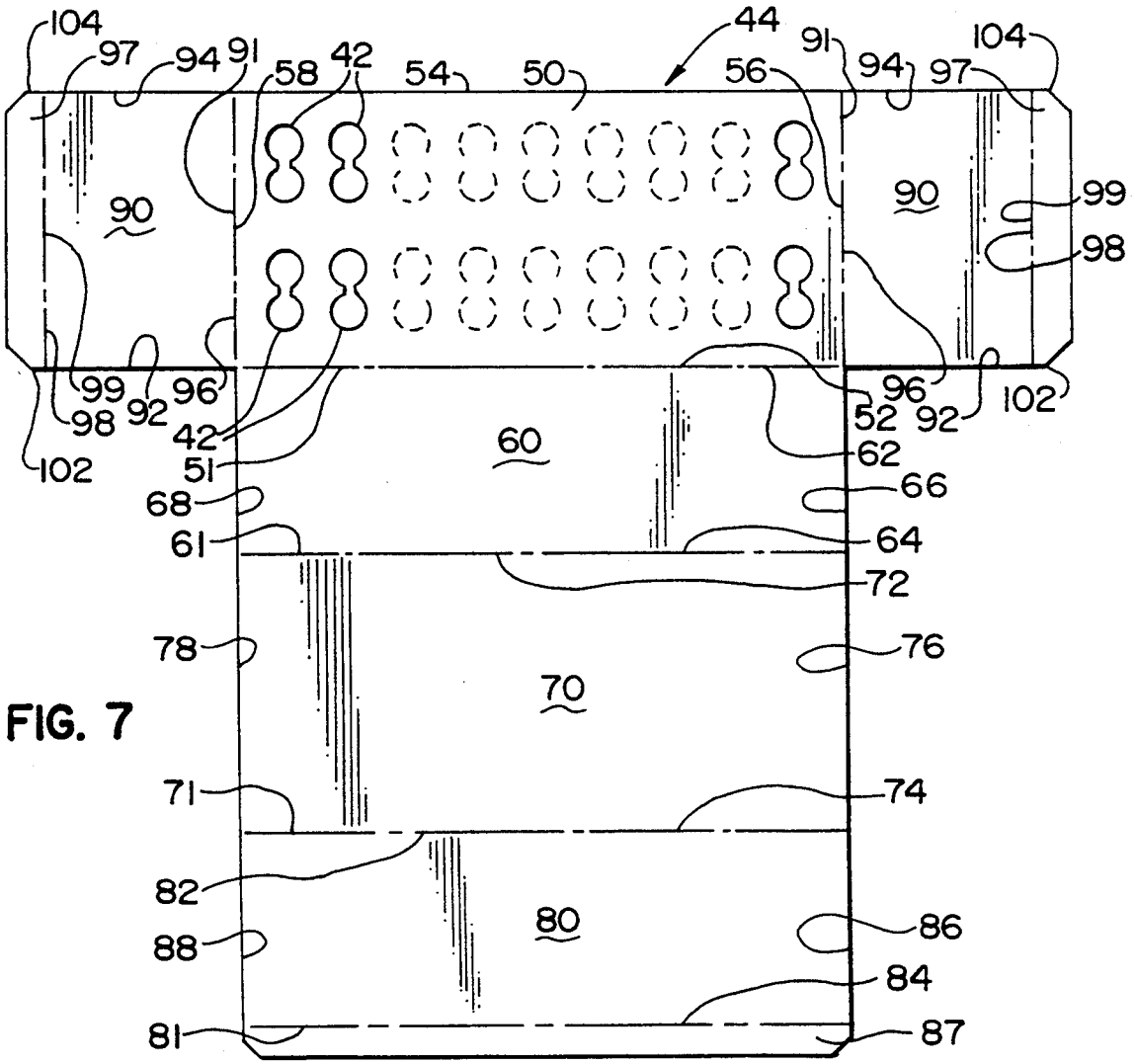
FIG. 7 is a top plan view of a flat planar sheet of material, such as heavy paper, that is cut and creased to form a preferred embodiment of a display used in combination with the present invention.

Turning to FIG. 7, a major component of the display 40 comprises a single planar blank or sheet 44 formed from either a heavy paper material, stiffened plastic sheeting, or other suitable material. A single die having sharp blade edges is used to cut the sheet material to form the blank 44, as illustrated by the solid lines in the drawings, and blunted edges on the die press into the sheet to form crease or fold lines, as illustrated by the dashed lines in the drawing.

As shown, the blank 44 has a planar, substantially rectangular and apertured top panel 50 hingedly connected along a crease line 51 to a planar and substantially rectangular side panel 60. In the illustrated embodiment, the side panel 60 is hingedly connected along a crease line 61 to a bottom panel 70 which, in turn, is hingedly connected along a crease line 71 to a side panel 80. The top panel 50 has generally rectangular closure flaps 90 extending from opposite sides thereof and hingedly connected thereto along crease lines 91.

As shown in FIG. 7, the top panel 50 defines inner and outer major surfaces with generally parallel front and rear edges 52 and 54, respectively, which are joined to each other by generally parallel side edges 56 and 58. The front and rear edges 52 and 54, respectively, of panel 50 are spaced apart by a predetermined first distance. The side edges 56 and 58 of top panel 50 are spaced apart by a second predetermined distance.

The side panel 60 defines inner and outer generally major surfaces with generally parallel top and bottom edges 62 and 64, respectively, and a pair of side edges 66 and 68. The top and bottom edges 62 and 64, respectively, of side panel 60 are spaced apart by a third predetermined distance. The side edges 66 and 68 are spaced apart from each other by said second predetermined distance. As shown, the front edge 52 of top panel 50 and the top edge 62 of side panel 60 are hingedly connected along crease line 51 which allows the side panel 60 to be folded at a generally right angle relative to the top panel 50.

The bottom panel 70 likewise defines inner and outer major surfaces with generally parallel front and rear edges 72 and 74, respectively, which are joined to each other by generally parallel side edges 76 and 78. The front and rear edges 72 and 74, respectively, of the bottom panel 70 are spaced apart by the same predetermined first distance as are edges 52 and 54 of the top panel 50. Similarly, the side edges 76 and 78 are spaced apart by a predetermined second distance which measures substantially the same as the distance separating the side edges 56 and 58 of the top panel 50. Notably, the bottom panel 70 is hingedly connected to the side panel 60 along the crease line 61 which allows the bottom panel 70 to extend at a right angle to the side panel 60 and generally parallel to the top panel 50 upon erection of the display.

The rectangular side panel 80 likewise defines inner and outer major surfaces and has a bottom edge 82 and top edge 84 which extend generally parallel to each other. The edges 82 and 84 of side panel 80 are spaced apart by substantially the same predetermined distance as are the edges 62 and 64 of side panel 60. Moreover, the edges 82 and 84 are joined by generally parallel side edges 86 and 88 which are spaced apart the same distance as are edges 56 and 58 of the top panel 50. The side panel 80 is hingedly connected to the bottom panel 70 along the crease line 71 which allows the side panel 80 to extend at a right angle relative to the bottom panel 70 upon erection of the display.

In the illustrated embodiment, the side panel 80 has a sealing flap 87 extending from an outer edge thereof. The sealing flap 87 is preferably connected to and hinged along a crease line 81 so as to be folded inwardly at a right angle to the side panel 80 and extend generally parallel to the top panel 50 upon erection of a box. Suitable adhesive or glue provided along the flap 87 secures the flap to the inner major surface of the top panel 50 thereby holding or maintaining the panels 50, 60, 70 and 80 in a quadrilateral formation relative to each other.

Each closure flap 90 has a substantially rectangular configuration including front and rear generally parallel edges 92 and 94, respectively, and top and bottom edges 96 and 98, respectively. Notably, the front and rear edges 92 and 94 are spaced apart the same predetermined first distance as are the edges 52 and 54 of the top panel 50. The top and bottom edges 96 and 98 of each closure flap 90 are spaced apart the same predetermined third distance as are the edges 62 and 64 of the side panel 60. As mentioned above, each closure flap is hingedly connected to a side edge of the top panel 50 along the respective crease line 91 whereby allowing the closure flap 90 to be bent vertically at a right angle relative to the top panel 50.

Each closure flap 90 has a narrow extension 97 hinged along a crease line 99 which defines the bottom edge 98 of the closure panel and allows the extension 97 to be folded inwardly at right angles to the closure flap 90. Notably, each extension 97 has generally parallel front and rear edges 102 and 104, respectively, which are spaced from each other the same predetermined first distance as are the spaced edges 52 and 54 of top panel 50.

Figure 8:
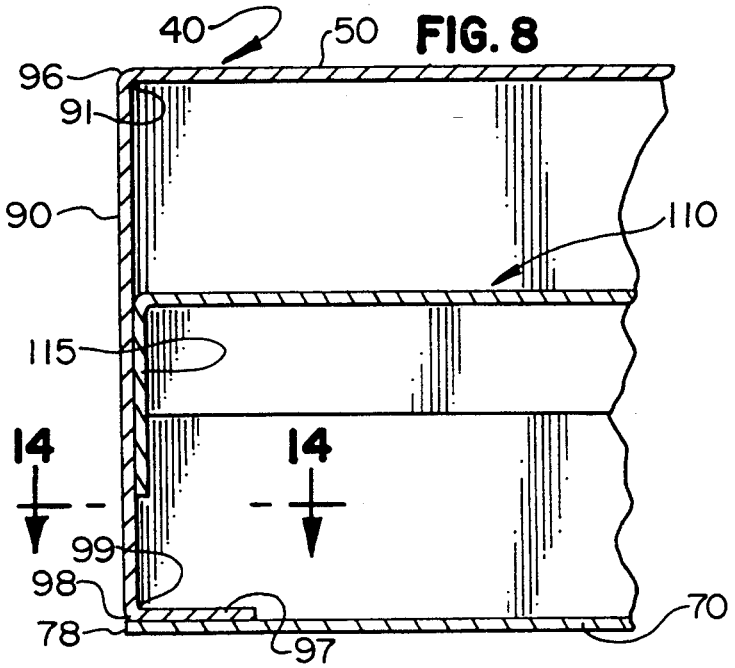
FIG. 8 is a sectional view taken along line 8–8 of FIG. 6.

Turning to FIG. 8, the display 40 further includes an apertured midpanel 110 arranged between and generally parallel to the top panel 50 and bottom panel 70. As shown, the midpanel 110 is formed from a single planar blank sheet 111 formed a heavy paper material, plastic sheeting or other suitable sheet material.

As shown in FIG. 9, the blank 111 has a planar rectangularly shaped and apertured panel 112. In the illustrated example, panel 112 has a sized configuration substantially similar to the top panel 50 (FIG. 7). Suffice it to say, panel 112 has front and rear extensions 113 and 114 and side supports 115 and 116 hingedly connected thereto along crease lines 117, 118, 119 and 120, respectively, which allow the extensions 113, 114 and supports 115, 116 to be turned at generally right angles relative to the panel 112. Notably, the crease lines 117 and 118 extend generally parallel to each other and are spaced apart by the same predetermined first distance as are the edges 52 and 54 (FIG. 7) of the top panel 50 of the blank 44. Moreover, the crease lines 119 and 120 extend generally parallel to each other and are spaced apart a distance which is less than the second predetermined distance separating the edges 56 and 58 of top panel 50. Each support 115, 116 includes generally parallel front and rear edges 122 and 124. The edges 122 and 124 of each support 115 and 116 are coplanar with the crease lines 117 and 118, respectively, of midpanel 110 and are adapted to engage the inner surfaces of the side panels 60 and 80 when the box is in an erected condition.

As shown in FIG. 10, after bending them generally perpendicular to the panel 112, the front and rear extensions 113 and 114, respectively, are secured as by gluing, stapling or the like to the inner major surfaces of the side panels 60 and 80, respectively, of the display 40. As will be appreciated, the front and rear extensions 113 and 114 are secured to the side panels 60 and 80, respectively, such that the panel 112 extends generally parallel to the top and bottom panels 50 and 70 and is endwise centered therebetween.

Figure 11:
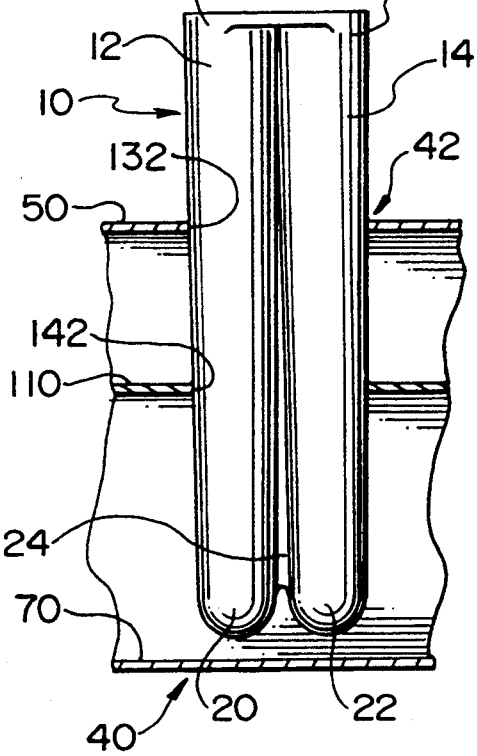
FIG. 11 is a sectional view taken along line 11–11 of FIG. 6.

The series of openings 42 provided on the display 40 slidably accommodate and vertically support dual vesselled beverage containers of the type described in detail above. As shown in FIG. 11, each opening 42 in the series of openings is defined by vertically aligned and specifically configured apertures 132 and 142 defined in the top panel 50 and midpanel 110, respectively, of the display 40.

Figure 12:
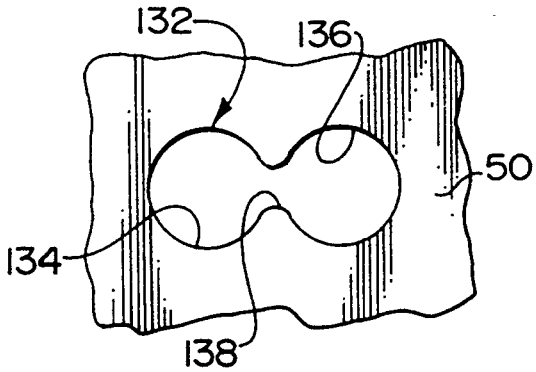
FIG. 12 is an enlarged top plan view of an opening defined by the display.

As shown in FIG. 12, each aperture 132 provided in the top panel 50 includes first and second holes or cutouts 134 and 136 which are arranged in an adjacent relationship relative to each other. The holes 134 and 136 have a configuration which closely proximates the cross-sectional configuration of the tubes 12 and 14 of the particular container 10 to be slidably accommodated in the display 40. Moreover, the holes 134 and 136 are spaced apart by a distance equal to the distance separating the adjacent tubes 12 and 14 of the beverage container 10 (FIG. 11). The holes 134 and 136 are joined to each other by a relatively narrow central passage 138. In the illustrated embodiment, the passage 138 is provided to allow the web 24 which joins the tubes 12 and 14 of the beverage container 10 (FIG. 11) to pass unobstructably through the top panel 50 of the display 40.

As noted above, each tube 12, 14 of the beverage container 10 preferably has an elongated tapered configuration extending between the top portions 16 and 18, respectively, and the bottom portions 20 and 22, respectively. Notably, the size of the holes 134 and 136 is approximately equal to the size of the tubes 12 and 14 at a location intermediate the top and bottom portions of each tube. By such construction, the peripheral edge of each circular opening 134 and 136 engages with an, ultimately, serves to slidably support the container 10 intermediate the ends thereof.

Figure 13:
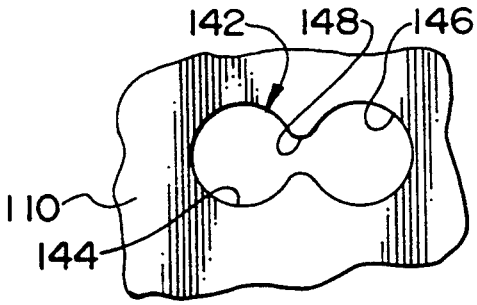
FIG. 13 is an enlarged top plan view of an opening defined by the midpanel of the display.

As shown in FIG. 13, each aperture 142 provided in the midpanel 110 likewise includes first and second holes or cutouts 144 and 146 which are arranged in an adjacent relationship relative to each other. The holes 144 and 146 have a configuration closely proximating the cross-sectional configuration of the tubes 12 and 14 of the particular container 10 to be slidably accommodated by the display 40. Moreover, the holes 144 and 146 are spaced apart by a distance generally equal to the distance separating the tubes 12 and 14 of the container 10. Because they engage and support a lower end of the tubes 12 and 14 of a container, the holes 144 and 146 can have a slightly smaller diameter than do the holes 134 and 136 in top panel 50 (FIG. 11). Notably, centerlines for the holes 134, 136 and 144, 146, respectively, are in vertical alignment and extend generally parallel relative to each other. The holes 144 and 146 are preferably joined to each other by a relatively narrow central opening or passage 148. In the illustrated embodiment, the passage 148 is provided to allow the web 24 which joins the tubes 12 and 14 (FIG. 11) to pass downwardly through the midpanel 110. In a manner similar to that discussed above, the edges of the holes 144 and 146 serve to engage and slidably support a lower end of the tubes 12 and 14 of each container 10. In effect, the holes 134, 136 and 144, 146 combine with each other to add vertical stability to each container slidably accommodated therewithin.

The display 40 allows several multi-vesselled beverage containers 10 to be arranged at a common location. Although each container 10 individually holds a relatively small volume, providing a multitude of such containers 10 at a common location greatly enhances the economics associated with the preparation of different beverages to be used in the containers 10. Moreover, one or more of the panels 50, 60, 70 and closure flaps 90 can have point-of-sale type advertisements readily and easily imprinted thereon for the purpose of promoting sale of the particular drink associated with the container 10.

The display 40 can be fabricated in an economical manner from any suitable paper or plastic sheeting product. Moreover, after the sealing flap 87 is secured to the inner major surface of the top panel 50, the panels 50, 60, 70 and 80 thereafter are maintained in a quadrilateral formation which allows the display 40 to be folded along the crease lines 51, 61 71 and 81 between a collapsed position and an open or erected position. Notably, the midpanel 110 is secured to the side panels 60 and 80 of the display 40 such that the midpanel 110 remains in a generally parallel relationship relative to the top and bottom panels 50 and 70, respectively, regardless of whether the display is in an open or collapsed position.

In a collapsed position, the panels of the display lie on top of one another to greatly reduce the shipping and storage size of the display 40. In an open or erected position, the display assumes a generally rectangular or box-like configuration with the top and bottom panels 50 and 70, respectively, arranged in a generally parallel relation relative to each other and with the side panels 60 and 80 extending generally parallel to each other and at a right angle relative to the top and bottom panels 50 and 70, respectively, to which they are joined. After the display is opened, the midpanel 110 extends generally parallel to the top and bottom panels 50 and 70, respectively, and is vertically positioned approximately midway of the side panels 60 and 80.

With the panels 50, 60, 70 and 80 and panel 112 of midpanel 110 having been folded along their crease lines such that the display is in an open or erected configuration, the supports 115 and 116 provided at opposite sides of the panel 112 are folded along the fold or crease lines 119 and 120, respectively, to extend generally perpendicular to the panel 112 of midpanel 110. In such position the front and rear edges 122 and 124 of each support 115 and 116 frictionally engage the inner major surfaces of the side panels 60 and 80, respectively, thereby facilitating the rectangular formation of the display .while adding rigidity thereto.

Similarly, and as seen in FIG. 8, the closure flaps 90 are folded relative to the top panel 50 along the crease lines 91 to extend generally perpendicular to the top panel 50 and close the open ends of the display 40. The narrow extensions 97 at the outer edges of the closure flaps 90 are then folded inwardly along the crease line 99 toward the display and generally perpendicular to the closure flap 90. After the extensions 97 are folded relative to their respective closure flaps 90, they are inserted between the side panels 60 and 80 and above the inner major surface of the bottom panel 70.

Figure 14:
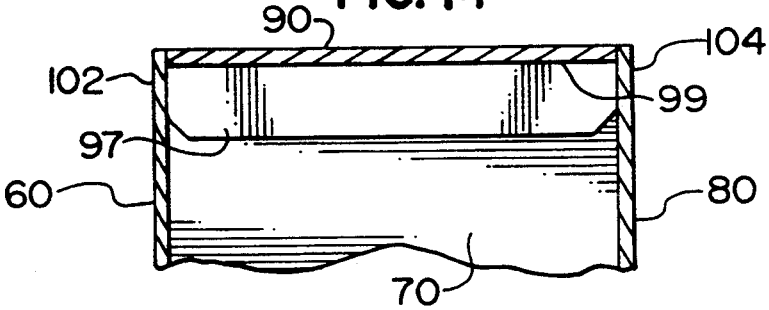
FIG. 14 is a sectional view taken along line 14–14 of FIG. 8.

As shown in FIG. 14, the front and rear edges 102 and 104, respectively, on each extension 97 of the closure flaps 90 are spaced apart substantially the same distance as that separating the inner major surfaces of the side panels 60 and 80. Thus, the edges 102 and 104 of the extensions 97 tend to engage the side panels thereby inhibiting the closure flaps 90 from becoming unfolded during normal use of the display 40. As seen in FIG. 7, the crease line 99 extends generally parallel to and is spaced from the fold line 91 at a distance equal to the distance separating the top and bottom edges 62, 82 and 64, 84 of the side panels 60, 80, respectively. Thus, the planar configuration of each extension 97 engages with the inner surface of the bottom panel 70. By this construction, forces imparted to the display 40, which would normally cause the display to collapse, are resisted by the rigidity of the closure flap 90 to which such forces are transmitted and absorbed. Moreover, the closure flaps 90 tend to maintain the supports 115, 116 (FIG. 8) in their proper orientation relative to the midpanel 110 thereby promoting rigidity of the display 40.

At this point, a stable six sided stand alone box-like display exists for slidably accommodating and vertically supporting a plurality of multi-vesselled beverage containers according to the present invention. As such, a plurality of the multi-vesselled containers according to the present invention are inserted into the display 40. As will be appreciated, the chamfer or tapered configuration provided at the lowermost or bottom portions 20, 22 of each tube 12, 14, respectively, facilitates the insertion of the containers 10 into the display 40. Each opening 42 in the display 40 individually accommodates and supports the containers 10 in a vertically upright position. Notably, the relatively narrow central passages 138 and 148 between adjacent holes 134, 136 and 144, 146, respectively, in each aperture 132 and 142 forming the openings 42 in the display permits the web 24 which joins the tubes 12 and 14 of each container 10 to unobstructably pass through the panels 50 and 110 of the display. Once the containers 10 are slidably accommodated in an opening 42 in the display 40, an upper portion of each container extends vertically above the top panel 50 of the display 40 (FIG. 11). Fabricating the containers 10 from a clear material thereby allows visual assessment of their beverage contents.

The vessels or tubes 12 and 14 of each container 10 can contain any suitable combination of beverages therein. The wall 30 (FIG. 3) which extends the length of the container and between the cavities 26 and 28 separates the cavities 26 and 28 from each other and, effectively, insulates the beverage in vessel or tube 12 from the beverage in vessel or tube 14 whereby minimizing temperature gradients between the beverages. Thus, a relatively hot drink or beverage can be provided in one tube while a relatively cold drink or beverage is provided in the other tube of the same container. The web 24 extending between the tubes 12 and 14 of each container adds strength and rigidity thereto.

The upper or top portions 16 and 18 of each tube are specifically configured to facilitate simultaneous pouring of the beverages from the cavities 26 and 28 directly into a person's mouth to effect a taste sensation not achievable by either of the .two beverages taken independently. That is, the top portions 16 and 18 of the interconnected tubes 12 and 14 are arranged in a generally coplanar relation relative to each other. Thus, when the container 10 is tilted to pour the beverages contained in the tubes 12, 14 into a person's mouth, the beverages are simultaneously discharged from the cavities 26 and 28 thus minimizing spillage.

The width between the outside edges of the top portions 16 and 18 of tubes 12 and 14, respectively, is such that the beverages released from the cavities 26 and 28 easily pour into a person's mouth such that the different beverages can be commingled to provide a taste sensation different from that independently provided by either beverage taken alone. In this regard, it has been found beneficial to specifically size the top portions of the container 10 such that the cumulative width measured between outer edges of the top portions 16 and 18 of the interconnected tubes ranges between about 0.875 inches and about 3.0 inches.

The open ends of the cavities 26 and 28 can be sealed to facilitate transportation of the containers 10 while inhibiting inadvertent spillage of the beverages therefrom. In the illustrated embodiment, a cap or cover 32 releasably engages with the top portions of the tubes 12 and 14 to prevent inadvertent spillage of the beverage in the cavities 26 and 28. Removal of the cap 32 allows the beverages to pour simultaneously from the cavities 26 and 28 in the desired manner to effect the desired results.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed:

1. A dual vesselled one-piece beverage container, comprising:

a pair of generally cylindrical tubes which are connected in adjacent relation to each other and define a pair of identical and separate blind cavities each capable of holding a type of liquid beverage therein, with each cavity having open top and closed bottom ends with at least one elongated sidewall extending between top and bottom ends of the cavity, and wherein the open top end of each cavity is equal to or larger than the bottom end to promote the discharge of said beverage from the cavity, said pair of tubes being connected to each other by an elongated web extending between and Substantially along the entire length of the tubes and such that their top ends are disposed in generally coplanar relation relative to each other, and wherein the circular cross-sectional configurations of the tubes are specifically shed toward the top ends to define a cumulative width between opposite outer surfaces thereof to permit simultaneous and direct pouring of the beverage contents of both tubes into a person's mouth to effect commingling of the beverages thereby achieving a taste sensation different from that provided by either beverage taken alone.

2. The beverage container according to claim 1 wherein said tubes are each molded from a clear plastic material to allow for visual assessment of the beverage held therewithin.

3. The beverage container according to claim 1 wherein said tubes are fabricated from a material which insulates the beverages held in the tubes from each other whereby temperature gradients between the beverages held within the tubes is minimized.

4. The beverage container according to claim 3 further including a releasable cover which fits over the top portions of the tubes to prevent inadvertent release of the beverages from said tubes.

5. A beverage container comprising:

two elongated tubes which are connected in adjacent relation relative to each other and define a pair of blind cavities, each cavity being capable of separately holding a type of liquid beverage therein, with each cavity having axially aligned open top and closed bottom ends, and wherein the open top end of..each cavity is equal to or larger than the bottom end so as to promote the discharge of said beverage from each cavity, the two tubes being connected to each other by a web extending between and substantially along the entire length of said tubes such that their top ends are disposed in generally coplanar relation relative to each other, and wherein the cross-sectional configurations of the two tubes are specifically sized toward their top ends to define a cumulative width between opposite outer surfaces of the tubes to facilitate pouring of the beverage contents of the tubes simultaneously and directly into a person's mouth whereat the beverages Commingle with each other to provide a desired taste sensation.

6. The beverage container according to claim 5 wherein each tube is fabricated from a material chosen from a class of: glass, plastic.

7. The beverage container according to claim 6 wherein each tube provides visual access with limited distortion to the beverage contained therewithin.

8. The beverage container according to claim 5 wherein each cavity has a volumetric capacity in the range of about 0.5 ounces to about 2.5 ounces.

9. The beverage container according to claim 5 further including a cover which seals the top portion of the tubes and which is removable therefrom to permit access to the beverage contained within each tube.

* * * * *